US005546831A

United States Patent [19]

Grant et al.

[11] Patent Number: 5,546,831

[45] Date of Patent: Aug. 20, 1996

[54] GRIPPING SYSTEM FOR ROTARY OBJECTS

[76] Inventors: Katherine M. Grant, deceased, late of Bellflower, Calif., by Frederic F. Grant, legal representative; Frederic F. Grant, 14505 Eastbrook Ave., Bellflower, Calif. 90706

[21] Appl. No.: 126,981

[22] Filed: Sep. 24, 1993

[51] Int. Cl.[6] ..... B67B 7/14

[52] U.S. Cl. ..... 81/3.44; 81/3.25; 81/92

[58] Field of Search ..... 81/3.25, 3.07, 81/3.4, 3.42, 3.44, 64, 92, 94, 97–99, 90.1–90.3, 111, 120, 179

[56] References Cited

U.S. PATENT DOCUMENTS

| | | | |
|---|---|---|---|
| 1,321,776 | 11/1919 | Stepanian | 81/120 |
| 1,328,389 | 1/1920 | Norwood | 81/92 |
| 1,837,257 | 12/1931 | Eames . | |
| 1,841,270 | 1/1932 | Aeschback et al. . | |
| 2,055,854 | 9/1936 | Stibbe | 81/3.44 |
| 2,431,550 | 11/1947 | Gary . | |
| 2,463,774 | 3/1949 | Jensen | 81/97 |
| 2,498,185 | 2/1950 | Shobe . | |
| 2,515,655 | 7/1950 | Kormuth . | |
| 2,630,031 | 3/1953 | Panik . | |
| 2,671,362 | 3/1954 | Wilson . | |
| 2,774,270 | 12/1956 | Daniel | 81/3.44 X |
| 3,570,028 | 3/1971 | de la Hitte | 81/3.4 |
| 4,085,632 | 4/1978 | Hogan et al. . | |
| 4,154,127 | 5/1979 | Russo . | |
| 5,154,101 | 10/1992 | Wolford et al. . | |

*Primary Examiner*—D. S. Meislin
*Attorney, Agent, or Firm*—Benoit Law Corporation

[57] ABSTRACT

Any one of several rotary objects of various diameters is gripped between a pair of joined jaws, without a need for manual adjustment of such jaws to any of the various diameters. To this end, the jaws are spaced at a taper to each other for all of the various diameters, and are pivoted, biased and rendered moveable relative to each other in diminution of that taper against the bias and conversely in self-restoration of the taper by the bias upon a release of the object from the jaws. Any one of the rotary objects may be wedged between the jaws at the taper, and one of the jaws is propelled with such wedged rotary object against the bias relative to the other jaw of the pair in diminution of the taper until the jaws exert optimum grip on the object. A loosening or other operation may then be performed on the wedged rotary object, and such wedged rotary object may be released from the jaws [for self-restoration of the taper by the bias.

44 Claims, 3 Drawing Sheets

GRIPPING SYSTEM FOR ROTARY OBJECTS

FIELD OF THE INVENTION

The subject invention relates to methods and apparatus for gripping rotary objects, to methods and apparatus for tightening or untightening threaded rotary objects, and to screw top looseners or jar or bottle openers and loosening or opening methods.

BACKGROUND

U.S. Pat. No. 1,837,257, by R. Eames, issued Dec. 22, 1931, disclosed a V-shaped fruit jar cap remover.

U.S. Pat. No. 1,841,270, by W. E. Aeschbach et al, issued Jan. 12, 1932, disclosed a V-shaped decapping tool carrying a sliding element, having humps arranged to center a screw-cap between them; the sliding element being arranged to carry the screw-cap into biting engagement with the gripping element; such biting engagement serving to hold the cap against rotation, whereupon the container is twisted to unscrew it from the cap.

U.S. Pat. No. 2,431,550, by H. H. Gary, issued Nov. 25, 1947, disclosed a screw top jar wrench including a serrated pivoted arm as part of a gripping jaw, having a slot at the pivot slanted for a better grip.

U.S. Pat. No. 2,498,185 by C. L. Shobe, issued Feb. 21, 1950, disclosed a screw top jar wrench including a serrated pivoted arm as part of a gripping jaw, having a slot at the pivot slanted for a better grip.

U.S. Pat. No. 2,515,655, by M. S. Kormuth, issued Jul. 18, 1950, disclosed a V-shaped wall-supported jar cap wrench.

U.S. Pat. No. 2,630,031, by J. J. Panik, issued Mar. 3, 1953, disclosed a jar cover wrench with pivoted jaws.

U.S. Pat. No. 2,671,632, by H. C. Wilson, issued Mar. 9, 1954, disclosed a V-shaped surface-mounted screw cap remover.

U.S. Pat. No. 4,085,632, by J. M. Hogan et al, issued Apr. 25, 1978, for a screw cap opener for jars and the like having screw caps or lids thereon consisting of a plastic holder preferably made of PVC-type material in various colors. Two metal blades are mounted in the plastic support holder at an angle to each other to form a V-shaped gripping structure. One of the blades has a smooth edge while the second blade edge has sawteeth formed therein.

U.S. Pat. No. 4,154,127, by A. J. Russo, issued May 15, 1979, disclosed an opener for screw top container having a base adapted to be secured to a wall, one or more notches in the front face of the base and an arm having at one end a jaw with a gripping surface, and at the other end a pivot, the arm being adjustable to one of a number of positions relative to the base to accommodate a variety of bottle cap sizes.

U.S. Pat. No. 5,154,101, by D. H. Wolford et al, issued Oct. 13, 1992, disclosed a combination jar or bottle cap remover and bag opener, consisting essentially of two side bars and a base. One side bar contains a gripping blade for removing caps and the other side bar contains a bag opening device.

Despite this abundance of prior-art proposal, the most popular jar and bottle top remover is the familiar under-the-kitchen-cabinet device that has serrated inside opposite a first inside edge for handling jaw tops and a closer second inside edge for handling smaller bottle tops; such first and second inside edges being stepped relative to each other.

A newer version has stepped curved inside ledges and a serrated cylindrical member inside such ledges. Bottle and jar tops are received between such cylindrical member and either of the curved ledges.

SUMMARY OF THE INVENTION

It is a general object of the invention to provide improved methods and apparatus for gripping rotary objects; It is a germane object of the invention to provide improved methods and apparatus for tightening or untightening threaded rotary objects.

It is a related object of the invention to provide improved screw to looseners or jar or bottle openers and loosening or opening methods.

It is also an object of the invention to provide devices of the above mentioned type with metrical advantage and operational facility for various users.

It is a related object of the invention to provide devices of the above mentioned type with high-friction gripping surfaces engageable by jar and bottle tops without exposure to damage.

Other objects of the invention become apparent in the further course of this disclosure.

The invention resides in methods of gripping any one several rotary objects of various diameters between a pair of joined jaws, without a need for manual adjustment of such jaws to any of the various diameters, comprising, in combination spacing the jaws at a taper to each other for all of the various diameters, pivoting, biasing and rendering the jaws moveable relative to each other in diminution of that taper against a bias imposed by such biasing and conversely in self restoration of the taper by the bias upon a release of the object from the jaws, wedging any one of the rotary objects between the jaws at the taper, propelling with the wedged rotary object one of the jaws against the bias relative to the other jaw of the pair in diminution of the taper until the jaws exert optimum grip on the object, performing an operation on the wedged rotary object, and releasing such wedged rotary object from the jaws for self-restoration of the taper by the bias.

In functional apparatus terms, the invention resides also in apparatus for gripping any one of several rotary objects of various diameters without a need for manual adjustment to any of said various diameters, comprising, in combination, a pair of object gripping jaws spaced at a taper to each other for all of various diameters, and means for pivoting, biasing and rendering these jaws moveable relative to each other in diminution of that taper against one of the rotary objects and against a bias imposed by that biasing and conversely in self-restoration of that taper by that bias upon a release of that object from the jaws.

In structural apparatus terms, the invention resides in apparatus for gripping any one of several rotary objects of various diameters without a need for manual adjustment of said to any of said various diameters, comprising in combination, a pair of object-gripping curved jaws spaced at a curved taper to each other for various diameters, an eccentric pivot between these curved jaws, and a bias between said curved jaws;

The invention in structural terms further resides in apparatus for gripping any one of several rotary objects of various diameters without a need for manual adjustment to any of said various diameters, comprising in combination, a pair of object-gripping jaws spaced at a taper to each other for the various diameters, a pivot having spaced pivot points between the jaws, and a bias between these jaws.

According to an embodiment of that aspect of the invention, the jaws are substantially straight at least in region of wedging of the rotary object between these jaws.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designated like or equivalent parts, and in which.

Figure 1:
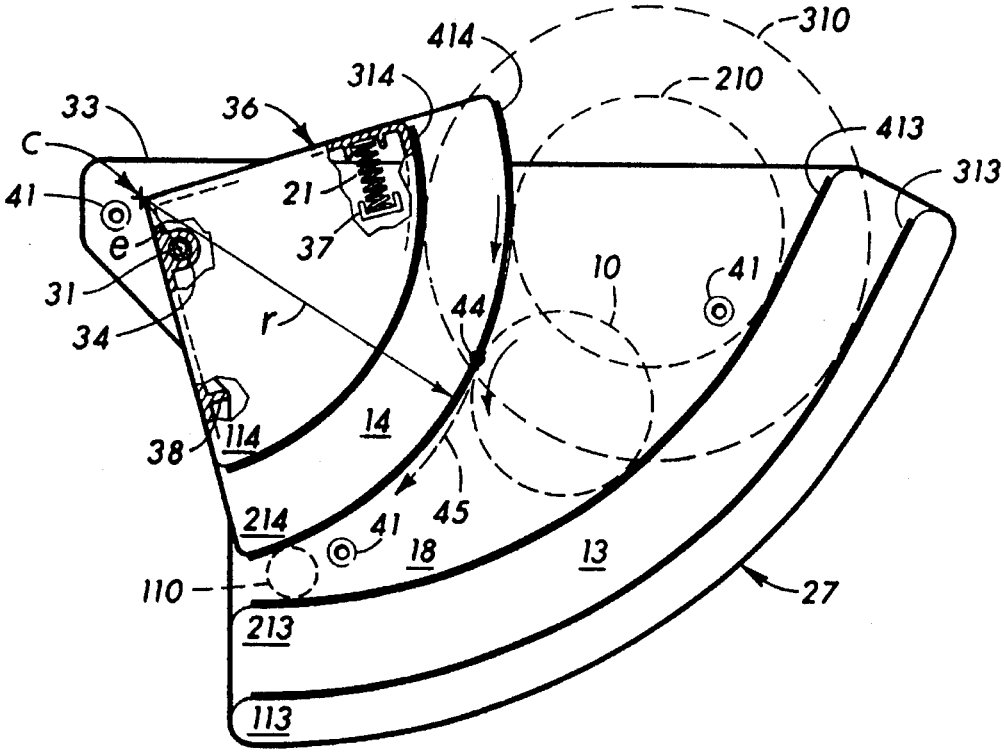
FIG. 1 is a plan view of a rotary object handling apparatus according to an embodiment of the invention.

Each of the illustrated side views is obtained by flipping its plan view about an imaginary horizontal line that can be visualized as extending between FIGS. 1 and 2, or 3 and 4, or 5 and 6. In this manner, an exemplary use of the illustrated apparatus that requires attachment to the underside of the unlined 39 is most easily understood.

DESCRIPTION OF PREFERRED EMBODIMENTS

The following is a written description of the invention in terms of preferred embodiments and features thereof.

The drawings show and this description discloses methods and apparatus for gripping any of the several rotary objects 10, 110, 210, 11 or 12 of various diameters between a pair of joined jaws 13 and 14, or 13 and 15, or 16 and 17, without a need for manual adjustment of such jaws to any of these various diameters, as was necessary with several prior-art proposals. In the further course of this description, the objects 10, 110, and 210 and where appropriate a further object 310 are summarized under the reference numeral "10", unless shown or described otherwise.

Also, there is a slight difference between the illustrated top and bottom views, as far as the showing of objects 10, 11 and 12 is concerned. In particular, in an effort to avoid an obstruction of significant parts of each side view by such objects, these objects 10, 11 and 12 have been shown in FIGS. 2, 4 and 6, respectively, as engaging the lower jaw liners 313 and 314. On the other hand, these objects have been shown as dotted circles 10, 11 and 12 between the inner jaw liners 413 and 414 in the plan view of FIGS. 1, 3 and 5 in order to illustrate the operation of each apparatus as plainly as possible.

According to preferred embodiment of the invention, the jaws 13 and 14, or 13 and 15, or 16 and 17 are spaced at a taper 18, 19 or 20 to each other for the various diameters contemplated for the apparatus or system comprising these jaws. Such embodiment further includes pivoting, biasing and rendering the jaws moveable relative to each other in diminution of the taper against a bias 21, 22 or 23 imposed by such biasing and conversely in self-restoration of that taper by the bias upon a release of the object from the jaws.

Any one of the rotary objects 10, 11 or 12 is wedged between the jaws 10, 11 or 12 at the taper 18, 19, or 20, and one of the jaws 14, 15 or 17 is propelled with that wedged rotary object against the bias 21, 22, 23 relative to the other jaw 13 or 16 of the pair in diminution of the taper 18, 19 or 20 until such jaws 13 and 14, 13 and 15, or 16 and 17 exert optimum grip on that object. The object may thus be released from, or tightened onto, another object, as the case may be, or the resulting grip on the object 10, 11, 12, etc. may be exploited in other respects for various instances of utility.

By way of typical example, the wedged rotary object 10, 11 and/or 12 may be a threaded lid or screw top on screw top container 26. In that case, the illustrated apparatus 27, 28 and 29 may be screw top looseners or jar or bottle openers; the term "screw top" being intended to be broad enough to extend to threaded bottle caps and to threaded lids, for instance, and the expression "screw top container" being intended to be broad enough to extend to jars, and other containers that feature such "screw tops."

The screw top loosening or unscrewing functions and all other operations that may be performed on, by or with the wedged rotary object are summarized herein by the phrase "performing an operation on the wedged rotary object."

The wedged object 10, 11 or 12 may thereupon be released from the jaw 13 and 14, 13 and 15, or 16 and 17 for self-restoration of the taper 18, 19 or 20 by the bias 22, 23, 24.

Figure 3:
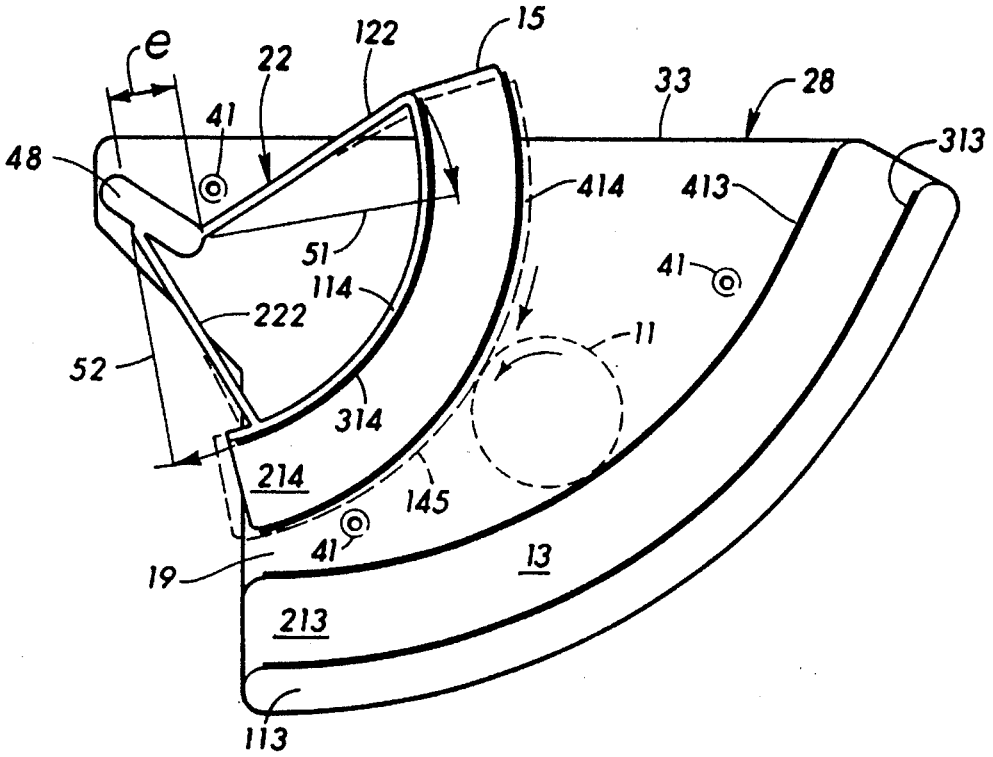
FIG. 3 is a plan view of a rotary object handling apparatus according to another embodiment of the invention.
Figure 5:
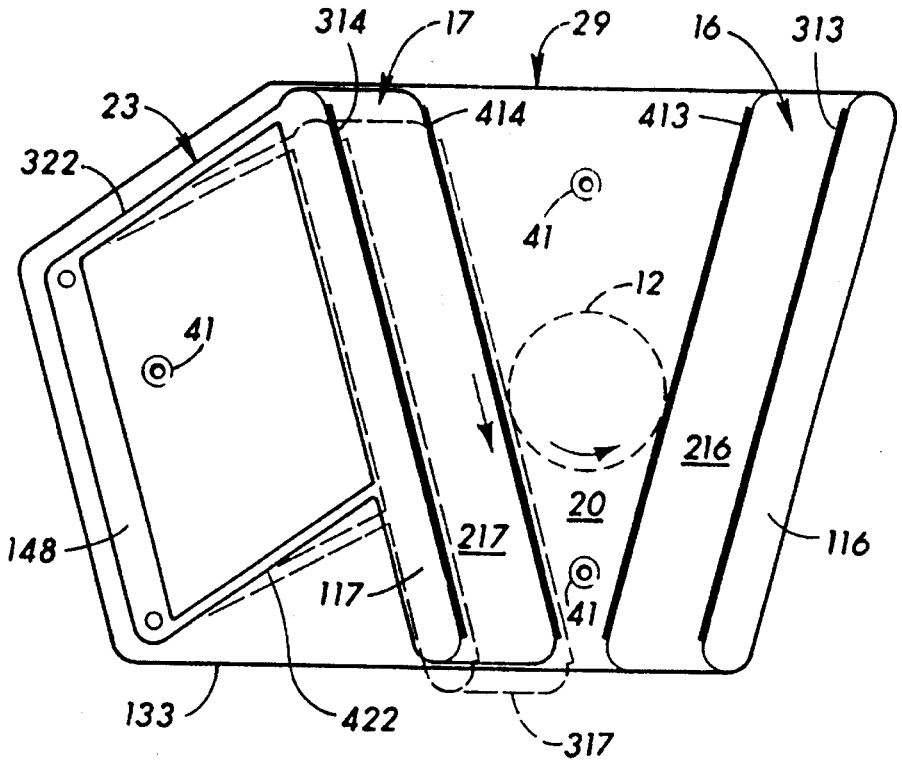
FIG. 5 is a plan view of a rotary object handling apparatus according to a further embodiment of the invention.

As indicated by curved solid arrows in FIGS. 1 and 3 and by a straight solid arrow in FIG. 5, the above mentioned propelling of one of the jaws 14, 15 or 17 includes translating angular movement of the wedged rotary object 10, 11 or 12 into movement of that one jaw relative to the other jaw 13 or 16 in diminution of the taper 18, 19 or 20. By way of example, but not by way of limitation, this way be accomplished by turning the screw top container 26 while the screw top 10, 11 or 12 is still tight thereon, so that torque imposed on the container 26 is transferred through the object 10, 11 or 12 to jaw 14, 15, or 17 relative to the jaw 13 or 16 for the above mentioned propelling and further actions.

Figure 6:
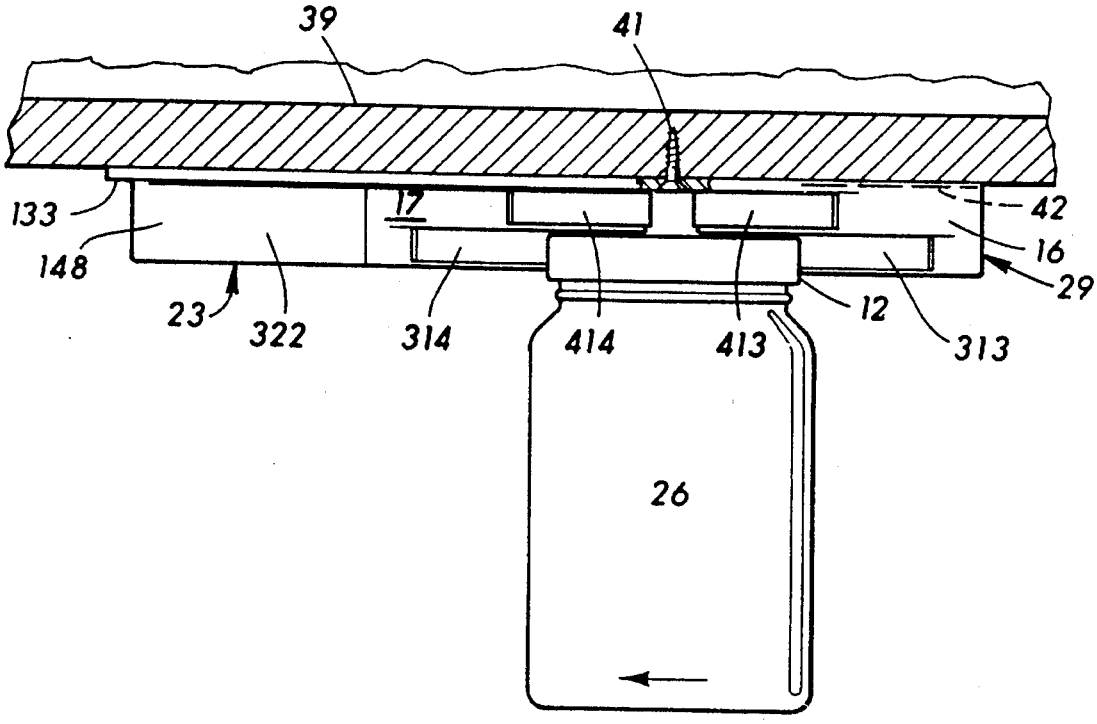
FIG. 6 is a side view of the apparatus of FIG. 5.

According to the embodiment shown in FIGS. 5 and 6, the jaws 16 and 17 are substantially straight at least in a region of wedging of the rotary object 10, 11 or 12 between such jaws.

On the other hand, the taper 18 or 19 between the jaws 13 and 14 or 13 and 15 may be curved as shown in FIGS. 1 to 4. In fact the jaws are curved according to embodiments shown in such figures.

More particularly, according to the preferred embodiments of the invention shown in FIGS. 1 to 4, one of the jaws 14 or 15 is curved differently from the other of the jaws 13.

According to a preferred embodiment of the invention, the above mentioned pivoting includes eccentrically pivoting the jaws relative to each other for movement of such jaws relative to each other in diminution of the taper and conversely in restoration of the taper 18, 19 or 20 upon a release of the object from the jaws.

By way of example, FIGS. 1 to 4 show one of the jaws 14 or 15 pivoted eccentrically at 31 or 32, respectively.

In this respect, the moveable jaw 14 as seen in FIG. 1 not only is curved about a shorter radius than the stationary jaw 13, but is pivoted at a point or shaft 31 that is offset from the center c or pivot point of the radius r, so that the curved jaw 14 is pivoted eccentrically at 31; such as at an eccentricity e.

In consequence, when the rotary object 10 is wedged between the jaws 13 and 14 and is angularly moved, such as by angular movement of a jaw 26 on which the object may be located as a screw top, that object 10 acts on both jaws. However, if the jaw 13 is stationary, then the angularly moving object 10 in effect propels the moveable jaw 14 about its eccentric pivot 31 or eccentricity e, as more fully described below.

Figure 2:
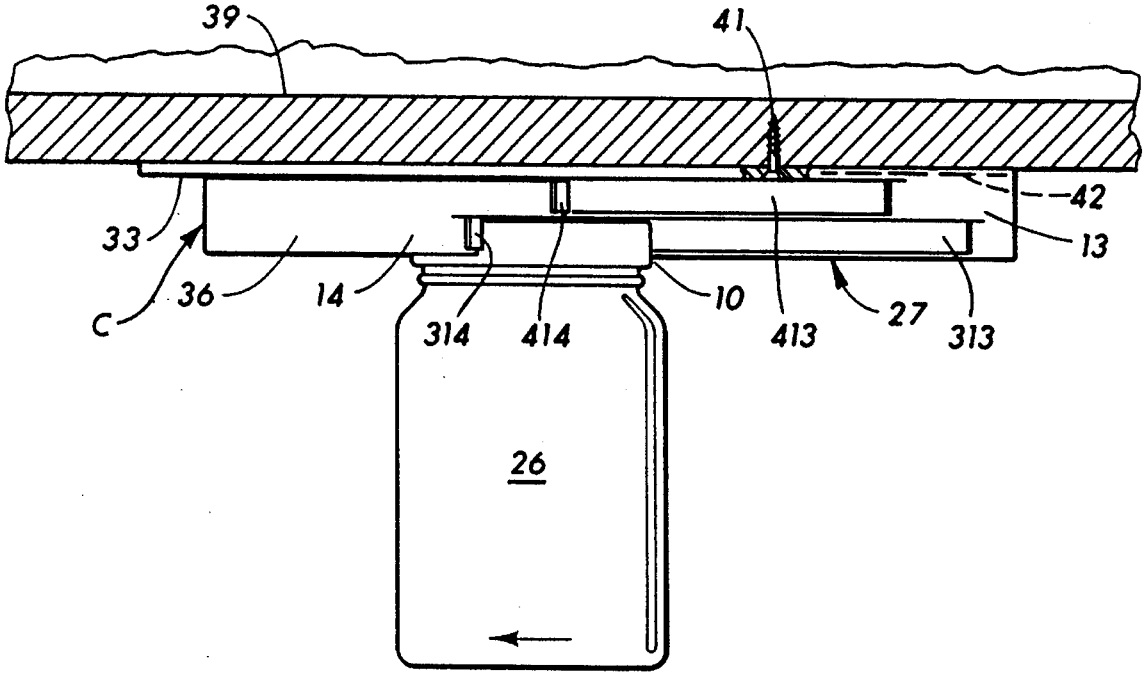
FIG. 2 is a side view of the apparatus of FIG. 1.

By way of background, the apparatus 27 shown in FIGS. 1 and 2 has a base 33 with the stationary jaw 13 being preferably integral therewith at a periphery thereof. The base 33 also carries a pivot pin for the eccentric pivot 31, having a sleeve bearing 34 angularly moveable thereon.

The apparatus 27 also has a segment 36 which has the moveable jaw 14 in a peripheral portion of reduced height. That segment includes the bearing sleeve 34 and is angularly moveable about its eccentric pivot 31.

This segment 36 is biased to a rest position by a compression spring providing the bias 21 against a stationary bracket 37 attached to the base 33. The segment 36 has a stop 38 that extends downwardly against a side of the base 33 to limit counter-clockwise [CCW] movement under the influence of the bias 21 as seen in FIG. 1. This establishes the initial taper 18.

If desired, the apparatus herein shown can be mounted to the underside of a kitchen cabinet or other surface 39, such as by screws 41 or other fasteners, including, for instance, an adhesive 42 that may be provided on the back of the base 33 and may be protected by peal-off label of sheet, pending installation of the apparatus.

As the wedged object 10 is angularly moved about its center as indicated by the solid arrow shown therein, it propels the moveable jaw 14 and segment 36 against the bias 21 clockwise [CW] as seen in FIG. 1 about the pivot 31. Because of the eccentricity e or eccentrically located pivot 31, the point 44 of tangential contact of the object 10 with the moveable jaw 14 tends to move in a trajectory that extends along part of the dotted line 45 shown in FIG. 1. In this or any similar manner, the moveable jaw 14 moves or is propelled in diminution of the taper 18, until the jaws 13 and 14 exert optimum grip on the object 10. At that moment, the object becomes loosened or unscrewed, if that object 10 is a screw top on a jaw 26 or is another device, such as a union or nipple, threaded on another structure, such as a pipe or tube.

The object 10 can then be pulled down or otherwise removed from the jaws 13 and 14 or apparatus 27. In this or any other manner, release of the rotary object 10 from the jaws 13 and 14 or apparatus 27 results in self-restoration of the taper 18 by the bias 21 acting on the segment 36 until the stop 38 again abuts the base 33.

If the jar or other structure 26 has not fully been removed from the object 10 prior to its removal from the apparatus 27, that object 10 may thereafter be fully unscrewed or otherwise removed from that structure 26.

The drawings presuppose that the object 10 is turned counter-clockwise [CCW] as see in FIG. 1, for instance. This, in turn, presupposes that the lid or object 10 is fastened on the jar or structure 26 by a right-hand thread, if the objective is to loosen or to unscrew the object from the structure.

A certain chirality may be noted in this respect between the threading or other requisite sense of rotation and the sense of the taper 18 in terms of diminution and restoration, such as by the biasing and the eccentric pivoting and curvature of the jaw 14 or segment 36 relative to the jaw 13.

For instance, because of that chirality as shown in FIG. 1, that apparatus 27 can also be used to tighten between the jaws 13 and 14 a rotary object that is threaded on a structure (e.g. 26) by a left-hand thread.

Conversely, if the objective is to loosen or unscrew such a left-hand-threaded object, then the apparatus 27 would have to be rearranged in a manner that becomes apparent to an observer who holds FIG. 1 against the light and reviews it through the backside of the paper on which it is drawn, with the jaws 13 and 14 being considered as extending in the direction of the observer from the base 33 as background.

According to a further embodiment of the invention, at least one of the jaws 13 and 14 is provided in steps 113 and 213 or 114 and 214, respectively, to accommodate further, or a larger variety of object diameters or sizes without a need for manual adjustment of the jaws or apparatus to any object diameter or size among that large variety, or without manual adjustment to any one of several size or diameter ranges within such large variety, as was necessary in the prior art.

According to another embodiment of the invention, the jaws 13 and 14, or their stepped sections 113, 213, 114 and 214, respectively, are lined with rubber or a synthetic elastomer instead of the serrated or saw-tooth object gripping surfaces that have been traditional in this art for a long time.

The jaws are thus lined with elastomer such as in the form of elastomeric liners 313, 413 and 414 engageable by the rotary objects, such as shown in FIGS. 1 and 2. While use of serrated jaws is not ruled out within the broad scope of the invention, coating or lining the jaws with an elastomer provides for the kind of engagement contemplated by traditional serrated edges, while avoiding the damage serrated edges tend to inflict on objects gripped thereby.

Figure 4:
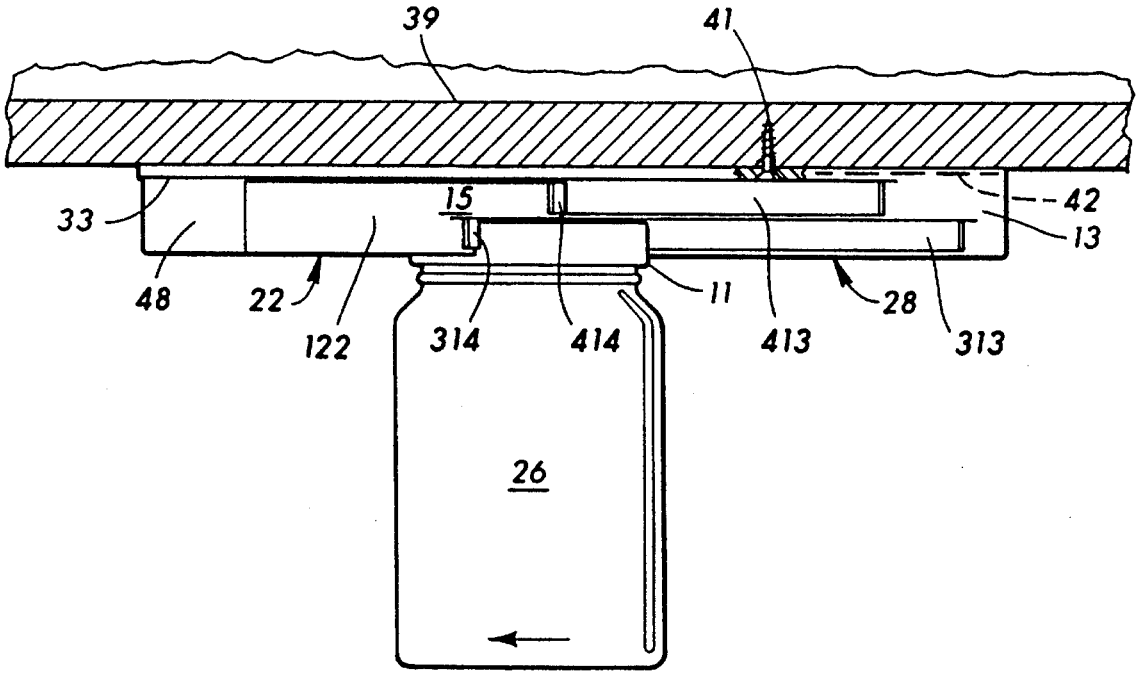
FIG. 4 is a side view of the apparatus of FIG. 2.

A presently more preferred embodiment of the invention is shown in FIGS. 3 and 4 where the jaws 13 and 15 are flexibly biased for imposition of the bias 22 for self-restoration of the taper 19.

In particular, the above mentioned pivoting includes pivoting one of the jaws 15 by angled pivot levers 122 and 222. These are flexible pivot levers attached to a coupler 48 which rises from the base 33. The base, with stepped jaws 13 and 15, coupler 48 and flexible jaw supporting arms or pivot levers 122 and 222 may for instance be molded in two pieces, such as from a thermosetting plastic material, and assembled, such as by welding at 48. In this respect FIGS. 3 and 5 show a one-piece assembly including the jaw 15 or 17 and two flexible pivot levers 122, 222 or 322, 422 attached to the base 33 or 133.

The other parts of the embodiment shown in FIGS. 3 and 4 may be the same as their counterparts in FIGS. 1 and 2, and same reference numerals are used for this purpose and to incorporate thereby the above description of the function and operation of such like or similar parts.

As indicated in FIG. 3 by thin lines 51 and 52, the flexible pivot levers 122 and 222 can deflect considerably, as angular movement of the object 11 wedged between the jaws 13 and 15 propels the moveable jaw 15 against the bias 22 of the flexible levers 122 and 222 clockwise [CW] as seen in FIG. 3 about the fixed coupler 48 attached to the base 33.

There also is an eccentricity e between the points at which the levers 122 and 222 are attached to the coupler 48 at spaced pivot points. The coupler thus acts as a kind of eccentric pivot for the moveable jaw 15. Because of this eccentricity, the point of tangential contact of the object 11 with the moveable jaw 15 tends to move in a trajectory that extends along part of the dotted line 145 shown in FIG. 3. In this or any similar manner, the moveable jaw 15 moves or is propelled in diminution of the taper 19, until the jaws 13 and 15 exert optimum grip on the object 11. At that moment, the object becomes loosened or unscrewed, and may otherwise be handled as described above for the object 10.

Another embodiment of the invention is shown in FIGS. 5 and 6 where the jaws also are flexibly biased for imposition of the bias 23 for self-restoration of the taper 20.

In particular, the above mentioned pivoting includes pivoting one of the jaws 17 by pivot levers 322 and 422 at spaced pivot points. In similarity to the embodiment of FIGS. 3 and 4, these are flexible pivot levers attached to a coupler 148 which is attached to a base 133. Instead of being angled relative to each other as in the embodiment of FIGS. 3 and 4, the flexible pivot levers may extend parallel or substantially parallel to each other as at 322 and 422 in FIG. 5.

In that embodiment of FIGS. 5 and 6, the jaws 16 and 17 or stepped jaws 116, 216, 117, 217, are substantially straight and extend or are arranged at an angle to each other for the provision of the taper 20.

The apparatus of FIG. 5 and 6 has base 113 which, together with stepped jaws 116 and 216 may be molded in one piece, while stepped jaws 117 and 217 with spaced flexible pivot levers 322 and 422 and coupler 148 may be molded in another piece, such as from a thermosetting plastic material, and assembled, such as by welding at coupler 148.

The other parts of the embodiment shown in FIGS. 5 and 6 may be the same as their counterparts in FIGS. 1 to 4, and same reference numerals are used for this purpose and to incorporate thereby the above description of the function and operation of such like or similar parts.

As indicated in FIG. 5 by a dotted outline 317, the flexible pivot levers 322 and 422 can deflect considerably, as angular movement of the object 12 wedged between the jaws 16 and 17 propels the moveable jaw 17 against the bias 23 of the flexible levers 322 and 422 as shown in FIG. 5 relative to the fixed coupler 148 attached to the base 133. Alternatively, the rhomboid or parallel bar support shown at 148-322-117-422 in FIG. 5 may be realized by rigid pivot lever pivoted or journaled at 117 and 148. In that case, a spring arrangement similar to that shown in FIG. 1 at 21 may be provided in the embodiment of FIGS. 5 and 6 to realize the bias 23 afforded by the flexible levers 322 and 422 there shown.

Because of the parallel bar or rhomboid jaw support shown in FIG. 5, the moveable jaw 17 tends to move to or in the dotted outline 317 shown in FIG. 5 when propelled by the angularly moving wedged object 12. In this or any similar manner, the moveable jaw 17 moves or is propelled in diminution of the taper 20, until the jaws 16 and 17 exert optimum grip on the object 12. At that moment, the object becomes loosened or unscrewed, and may otherwise be handled as described above for the objects 10, etc.

As apparent from this disclosure, the apparatus 27, 28, 29 for gripping any one of several rotary objects 10, 110, 210 of various diameters without a need for manual adjustment to any of such various diameters, comprise a pair of object-gripping jaws 13, 14; 13, 15; 16, 17 spaced at a taper 18, 19, 20 to each other of the various diameters. In function-related terms, these apparatus include means 31, 34, 48, 122, 222, 148, 322, 422 for pivoting, biasing and rendering such jaws moveable relative to each other in diminution of that taper against one of the rotary objects 10, 11, 12, 110, 210 and against a bias imposed by that biasing 21; 122, 222; 322, 422 and conversely in self-restoration of that taper by that bias upon a release of that object from the jaws.

In structural terms, the apparatus 27 and 28 for gripping any one of several rotary objects of various diameters without a need for manual adjustment to any of various diameters, comprise, in combination, a pair of object-gripping curved jaws 13, 14; 13, 15 spaced at a curved taper 18, 19 to each other for various diameters, an eccentric pivot 31, 48, 122, 222 between these curved jaws, and a bias 21; 122, 222 between such curved jaws.

Also in structural terms, the apparatus 28 and 29 for gripping any one of several rotary objects of various diameters without a need for manual adjustment to any of such various diameters, comprise, in combination, a pair of object-gripping jaws 13, 15; 16, 17 spaced at a taper 19, 20 to each other for various diameters, a pivot 48, 148 having spaced pivot at points 122, 222; 322, 422 between the jaws, and a bias 122, 222; 322, 422 between the jaws.

In the embodiment illustrated in FIGS. 5 and 6, the jaws 16 and 17 are substantially straight at least in a region of engagement of the rotary object 12 between such jaws.

In the embodiment illustrated in FIGS. 1 to 4, the taper 18, 19 between the jaws 13, 14; 13, 15 is curved, and these jaws are curved. As seen in FIGS. 1 and 3, one of the jaws 13 is curved differently from the other jaw 14, 15.

According to an embodiment of the invention, an eccentric pivot 31, 48 pivots the jaws 13, 14; 13, 15 relative to each other, such as shown in FIGS. 1 to 4. The pivot may include spaced pivot points, such as seen of 122, 222 or 322, 422 in FIGS. 3 and 5. As also shown in these figures, the apparatus may include flexible pivot members 122, 222, or 322, 422.

FIG. 5 shows parallel pivot levers 322 and 422, while FIG. 3 shows angled pivot levers 122, 222.

According to a preferred embodiment of the invention elastomer linings 313, 314, 413, 414 are on the jaws 13, 14, 15, 16, 17, etc. and are engageable by the rotary objects 10, 11, 12, 110, 210, 310. According to an embodiment of the invention at least one of the jaws is stepped whereby to accommodate further object sizes. In all illustrated embodiments, both jaws 13, 14; 13, 15; 16, 17 have corresponding steps 113, 213; 114, 214;.116, 117; 216, 217 whereby to accommodate further object sizes 310 etc.

Various modifications and variations within the spirit and scope of the subject invention are apparent to those skilled in the art from the subject extensive disclosure.

We claim:

1. Apparatus for gripping any one of several rotary objects of various diameters without a need for manual adjustment to any of said various diameters, comprising in combination:

a pair of object gripping jaws spaced at a taper to each other for said various diameters;

a stationary base for one of said jaws; and flexible pivot lever means including spaced pivot levers between said base and the other of said jaws for pivoting, biasing and rendering said other of the jaws moveable relative to said one of the jaws in diminution of said taper against one of said rotary objects and against a bias imposed by said biasing and conversely in self-restoration of said taper by said bias upon a release of said object from said jaws.

2. Apparatus as in claim 1, wherein:

said jaws are substantially straight at least in a region of engagement of the rotary object between said jaws.

3. Apparatus as in claim 1, wherein:

said taper between said jaws is curved.

4. Apparatus as in claim 1, wherein:

said jaws are curved.

5. Apparatus as in claim 1, wherein:

one of said jaws is curved differently from the other of said jaws.

6. Apparatus as in claim 1, wherein:

said flexible pivot lever means is eccentric.

7. Apparatus as in claim 1, including:

elastomer lining on said jaws engageable by said rotary objects.

8. Apparatus as in claim 1, wherein:

one of said jaws is stepped whereby to accommodate further object sizes.

9. Apparatus as in claim 1, wherein:

said jaws have corresponding steps whereby to accommodate further object sizes.

10. Apparatus for gripping any one of several rotary objects of various diameters without a need for manual adjustment to any of said various diameters, comprising in combination:

a pair of object gripping jaws spaced at a taper to each other for said various diameters;

a stationary base for one of said jaws; and flexible pivot lever means between said base and the other of said jaws for pivoting, biasing and rendering said other of the jaws moveable relative to said one of the jaws in diminution of said taper against one of said rotary objects and against a bias imposed by said biasing and conversely in self-restoration of said taper by said bias upon a release of said object from said laws;

said flexible pivot lever means including flexible pivot levers attached to said base.

11. Apparatus as in claim 10, wherein:

said jaws are substantially straight at least in a region of engagement of the rotary object between said jaws.

12. Apparatus as in claim 10, wherein:

said jaws are curved.

13. Apparatus as in claim 10, wherein:

said flexible pivot lever means is eccentric.

14. Apparatus as in claim 10, including:

elastomer lining on said jaws engageable by said rotary objects.

15. Apparatus as in claim 10, wherein:

one of said jaws is stepped whereby to accommodate further object sizes.

16. Apparatus as in claim 10, wherein:

said jaw have corresponding steps whereby to accommodate further object sizes.

17. Apparatus for gripping any one of several rotary objects of various diameters without a need for manual adjustment to any of said various diameters, comprising in combination:

a pair of object gripping jaws spaced at a taper to each other for said various diameters;

a stationary base for one of said jaws; and flexible pivot lever means including parallel pivot levers between said base and the other of said jaws for pivoting, biasing and rendering said other of the jaws moveable relative to said one of the jaws in diminution of said taper against one of said rotary objects and against a bias imposed by said biasing and conversely in self-restoration of said taper by said bias upon a release of said object from said jaws.

18. Apparatus as in claim 17, wherein:

said jaws are substantially straight at least in a region of engagement of the rotary object between said jaws.

19. Apparatus as in claim 17, including:

elastomer lining on said jaws engageable by said rotary objects.

20. Apparatus as in claim 17, wherein:

one of said jaws is stepped whereby to accommodate further object sizes.

21. Apparatus as in claim 17, wherein:

said jaws have corresponding steps whereby to accommodate further object sizes.

22. Apparatus for gripping any one of several rotary objects of various diameters without a need for manual adjustment to any of said various diameters, comprising in combination:

a pair of object gripping jaws spaced at a taper to each other for said various diameters;

a stationary base for one of said jaws; and flexible pivot lever means including angled pivot levers between said base and the other of said jaws for pivoting, biasing and rendering said other of the jaws moveable relative to said one of the jaws in diminution of said taper against one of said rotary objects and against a bias imposed by said biasing and conversely in self-restoration of said taper by said bias upon a release of said object from said jaws.

23. Apparatus as in claim 22, wherein:

said taper between said jaws is curved.

24. Apparatus as in claim 22, wherein:

said jaws are curved.

25. Apparatus as in claim 22, wherein:

one of said jaws is curved differently from the other of said jaws.

26. Apparatus as in claim 22, wherein:

said flexible pivot lever means is eccentric.

27. Apparatus as in claim 22, wherein:

one of said jaws is stepped whereby to accommodate further object sizes.

28. Apparatus as in claim 22, wherein:

said jaw have corresponding steps whereby to accommodate further object sizes.

29. Apparatus for gripping any one of several rotary objects of various diameters without a need for manual adjustment to any of said various diameters, comprising in combination:

a pair of object-gripping jaws spaced at a taper to each other for said various diameters;

a stationary base for one of said jaws; and a one-piece assembly including the other of said jaws having two flexible pivot levers attached to said base.

30. Apparatus as in claim 29, wherein:

one of said jaws is curved differently from the other of said jaws.

31. Apparatus as in claim 29, wherein:

said pivot levers include spaced pivot points attached to said base.

32. Apparatus as in claim 29, wherein:

said one-piece assembly includes a coupler between said flexible pivot levers and said base.

33. Apparatus as in claim 29, wherein:

said pivot levers are angled relative to each other in said one-piece assembly.

34. Apparatus as in claim 29, including:

elastomer linings on said jaws engageable by said rotary objects.

35. Apparatus as in claim 29, wherein:

one of said jaws is stepped whereby to accommodate further object sizes.

36. Apparatus as in claim 29, wherein:

said jaws have corresponding steps whereby to accommodate further object sizes.

37. Apparatus for gripping any one of several rotary objects of various diameters without a need for manual adjustment to any of said various diameters, comprising in combination:

a pair of object-gripping jaws spaced at a taper to each other for said various diameters;

a stationary base for one of said jaws;

parallel pivot levers mounting the other of said jaws and attached to said base; and a bias for said pivot levers relative to said base.

38. Apparatus as in claim 37, wherein:

said jaws are substantially straight at least in a region of wedging of the rotary object between said jaws.

39. Apparatus as in claim 38, including:

elastomer linings on said jaws engageable by said rotary objects.

40. Apparatus as in claim 37, including:

a rhomboid support including said parallel pivot levers.

41. Apparatus as in claim 40, wherein:

said parallel pivot levers are flexible in said rhomboid support.

42. Apparatus as in claim 38, wherein:

one of said jaws is stepped whereby to accommodate further object sizes.

43. Apparatus as in claim 38, wherein:

said jaws have corresponding steps whereby to accommodate further object sizes.

44. Apparatus for gripping any one of several rotary objects of various diameters without a need for manual adjustment to any of said various diameters, comprising in combination:

a pair of object-gripping jaws spaced at a taper to each other for said various diameters;

a stationary base for one of said jaws;

parallel flexible pivot levers mounting the other of said jaws and attached to said base.

* * * * *